United States Patent [19]

Keele, Jr.

[11] Patent Number: 4,580,655

[45] Date of Patent: Apr. 8, 1986

[54] DEFINED COVERAGE LOUDSPEAKER HORN

[75] Inventor: D. Broadus Keele, Jr., Camarillo, Calif.

[73] Assignee: JBL Incorporated, Northridge, Calif.

[21] Appl. No.: 539,351

[22] Filed: Oct. 5, 1983

[51] Int. Cl.[4] ..... G10K 11/00

[52] U.S. Cl. ..... 181/192; 181/187; 181/195

[58] Field of Search ..... 181/192, 195, 187

[56] References Cited

U.S. PATENT DOCUMENTS

| | | | |
|---|---|---|---|
| 1,381,430 | 6/1921 | Phipps | 181/192 |
| 1,767,679 | 6/1930 | Hutchison | 181/187 X |
| 2,537,141 | 6/1945 | Klipsch | 181/187 |
| 4,071,112 | 1/1978 | Keele, Jr. | 181/187 |
| 4,308,932 | 1/1982 | Keele, Jr. | 181/187 |

FOREIGN PATENT DOCUMENTS 227545 1/1925 United Kingdom .

*Primary Examiner*—Benjamin R. Fuller

*Attorney, Agent, or Firm*—Nilsson, Robbins, Dalgarn, Berliner, Carson & Wurst

[57] ABSTRACT

Opposed side walls of a loudspeaker horn are constructed to direct portions of a sound beam toward a target over different preselected included angles, producing an incident beam which is substantially coextensive with the target. The side walls preferably extend downstream at the preselected angles over a distance at least comparable to a maximum wavelength at which the horn is to be used.

9 Claims, 9 Drawing Figures

DEFINED COVERAGE LOUDSPEAKER HORN

BACKGROUND OF THE INVENTION

The present invention relates generally to the loudspeaker field and, more particularly, to a defined-coverage loudspeaker horn.

Early systems for directing sound over a predefined area typically involved a number of cone-type loudspeakers grouped together, as in linear, two-dimensional and phased arrays. However, such systems were only modestly successful at distributing high frequency sound. They were also costly, particularly when the area was large or irregularly shaped.

Horns were first introduced to increase the efficiency at which sound is produced in an audio system. Efficiency was of primary concern because amplifiers were very costly and limited in output. However, recent advances in amplification systems have shifted the emphasis from efficiency to considerations of coverage, directivity and frequency response. Two horns addressing these considerations are disclosed in U.S. Pat. No. 2,537,141 to Klipsch and U.S. Pat. No. 4,308,932 to Keele, Jr.

The Klipsch patent is directed to a radial horn of "astigmatic" construction, wherein expansion of an acoustic signal takes place initially in a single plane before commencing at right angles to that plane. This is desirable to maintain a uniform phase of the signal over the mouth of the horn, such that the wavefront is a substantially spherical surface independent of frequency. The Klipsch device is well suited to circumstances calling for a radial wavefront of constant directivity, but is incapable of generalized coverage control.

The Keele patent discloses an improvement to the Klipsch horn, wherein two opposing side walls are flared outwardly according to a power series formula to enhance low frequency and midrange response. The horn of the Keele patent achieves directional characteristics substantially independent of frequency, but is limited in attainable coverage patterns in the same manner as the Klipsch horn.

Most recently, designers of loudspeaker horns have focused on attaining a uniform direct-field sound pressure level at all listener positions. Uniform sound pressure is difficult to obtain because most listener areas do not match the polar patterns of available loudspeakers. Even when the output of a single source is high enough to cover an area, the source will not suffice if it lacks proper directional characteristics. In addition, the phenomenon of "inverse rolloff", i.e., the decrease in sound pressure with increasing beam area, typically causes pressure to vary drastically over an area covered by a single source. Directivity and rolloff considerations can be addressed with clusters of short, medium and long throw horns directed to different portions of the area, but such systems are significantly more expensive than a single loudspeaker.

Therefore, it is desirable in many applications to provide a horn for directing sound from a single driver over a defined area at substantially constant directivity and pressure level.

SUMMARY OF THE INVENTION

A loudspeaker horn for directing sound from a driver having a principal axis of propagation to a target area having a plurality of portions located different distances from the driver comprises: means for radiating a sound beam generated by the driver; and a pair of symmetric opposed side walls extending outwardly from the radiating means, the side walls being constructed and arranged to direct a first portion of the beam toward a first portion of the target over a first preslected included angle, and to direct at least one other portion of the beam toward another portion of the target over a different preselected included angle, the first and second angles being chosen to produce a substantially uniform sound intensity over the target area. In a preferred embodiment, the target portions are located different distances from the radiating means, and the included angles are chosen such that each portion of the beam, i.e., "beamlet", is substantially coextensive with the respective target portion at a location of incidence thereon. The side walls substantially define the included angles over regions extending downstream of the radiating means a distance at least comparable to the maximum wavelength at which the loudspeaker is to operate. In one embodiment, the side walls comprise first and second pairs of opposed walls extending outwardly from the radiating means, which may be a radiating gap, for controlling sound dispersion in the direction of minor and major dimensions, respectively, of the gap. The second pair of side walls has regions adjacent to the gap which define a uniform preselected included angle emanating from a vertex upstream of the gap, and the first pair of side walls has a portion adjacent to the radiating gap which defines different preselected included angles at different lateral cross sections containing a line which passes through the vertex of the second pair of side walls and is parallel to the direction of the minor dimension.

In the horn of the present invention, the angle of the path provided by the first walls is determined by the line of sight path between the radiating source and the boundary of the target. The first walls define a relatively narrow path to a remote portion of the target so that the beamwidth will correspond substantially to the width of the target area at the time of incidence. If the beam to a remote portion of the target were not initially narrow, it would be far too wide upon reaching the target. At the same time, the narrow conductive path causes sound energy passing along it to be compressed relative to sound directed along a wider path. This enhances the pressure level at the remote location and counteracts inverse rolloff of pressure with distance. When the target has a constant width, the sound pressure is substantially uniformly distributed over the area.

Although the most dramatic results are achieved in the case of rectangular target areas in which the horn of the present invention is positioned over a longitudinal axis of the area, the defined-coverage concept of the invention is believed applicable to areas of any outline, whether regular or irregular. In such cases, the configuration of the side wall surface is determined essentially by the line of sight relationship, but the sound pressure level may be less uniform than in the case of rectangular target areas. When an area is too large for a single loudspeaker, a number of the horns can be utilized at different locations, treating each smaller area as a separate target plane.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
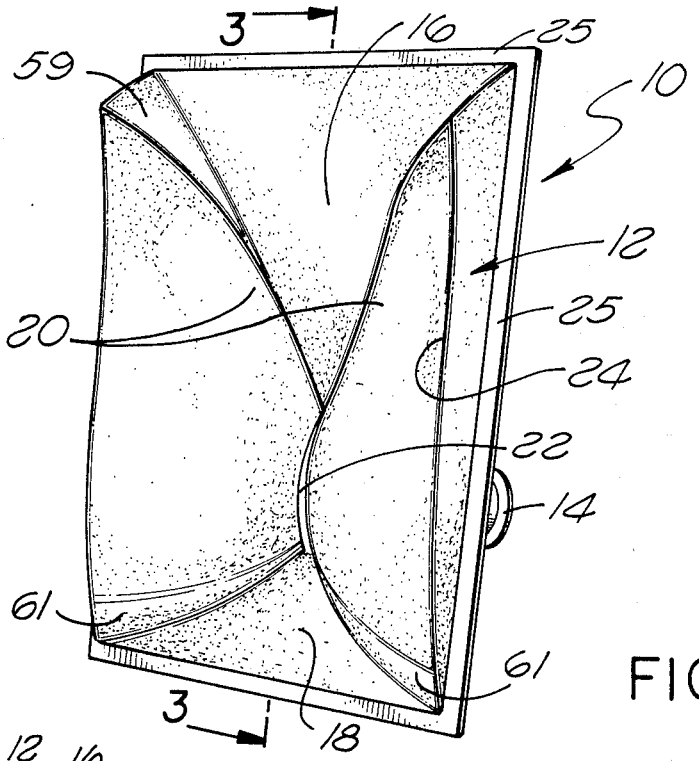
FIG. 1 is an isometric frontal view of a loudspeaker horn constructed according to one embodiment of the present invention.

Referring now to the drawings, FIG. 1 illustrates a loudspeaker assembly 10 made up of a horn 12 and a compression driver 14. The horn has a pair of upper and lower opposed side walls 16 and 18, respectively, and a pair of opposed lateral side walls 20, providing a divergent path from a gap outlet 22 to an open mouth 24. According to the teachings of the present invention, the lateral side walls 20 define an included angle which varies with the angle of elevation along the gap outlet. A peripheral flange 25 facilitates mounting of the horn.

Figure 2B:
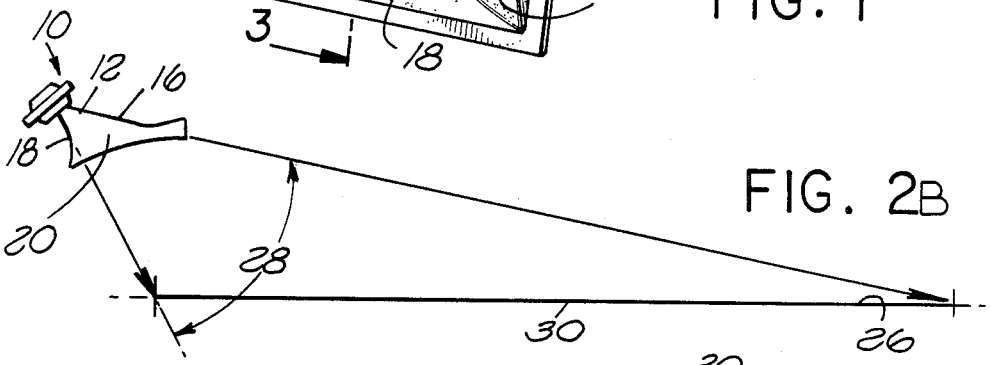
FIGS. 2A and 2B are schematic representations of the coverage characteristics of the horn of FIG. 1 relative to a predetermined rectangular area, as seen from the top and side of the area, respectively.
Figure 2A:
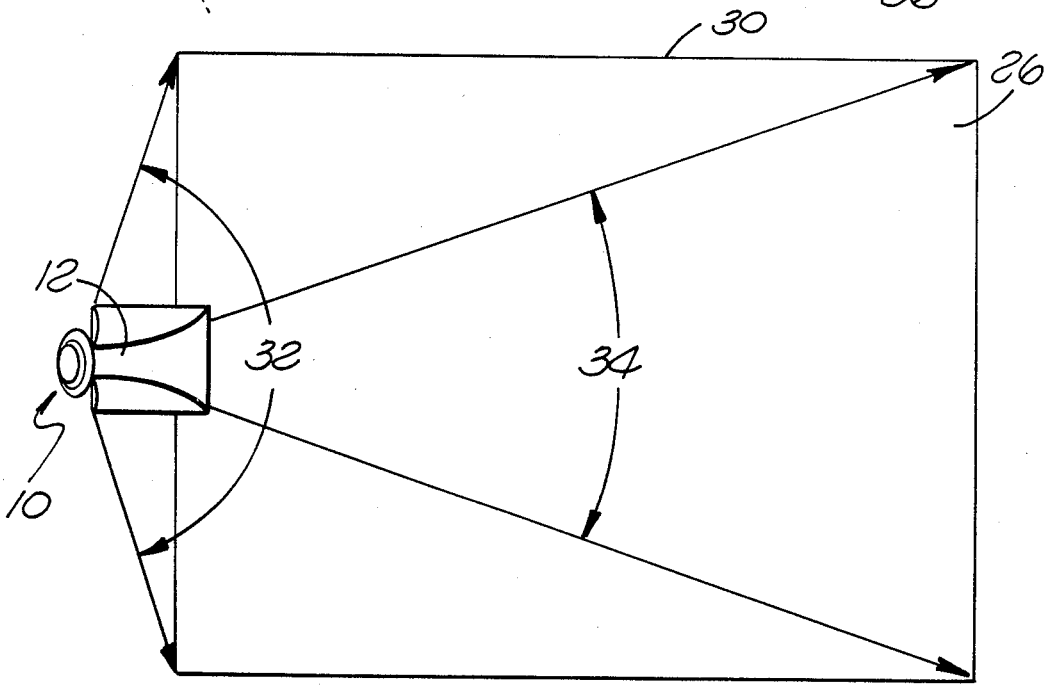

As seen in FIGS. 2A and 2B, the loudspeaker 10 is positionable above and to the rear of a rectangular target area 26 to direct sound uniformly over the target. The upper and lower side walls of the horn direct sound over a constant angle 28 to cover the entire length 30 of the target area, and the side walls 20 define different lateral coverage angles for different points along the length 30. In the direction of the near end of the target, the side walls are configured to direct sound over a coverage angle 32. For convenience, this direction is defined as that of zero degrees (0°) elevation, with the maximum angle of elevation being toward the remote end of the target plane. As the elevation angle increases toward its maximum, the lateral coverage angle defined by the sidewalls 20 decreases. This concentrates sound toward the remote regions of the target and produces a beam of appropriate width at those regions. The coverage angle defined by the walls 20 decreases continuously in the illustrated embodiment from the maximum value 32 to a minimum value 34 to account for the natural broadening of the beam and "inverse rolloff" of intensity as the beam travels through air. In all cases, the horn walls near the gap conform rather closely to the surface defined by line of sight between each point on the gap outlet and the corresponding point on the target periphery.

Figure 3:
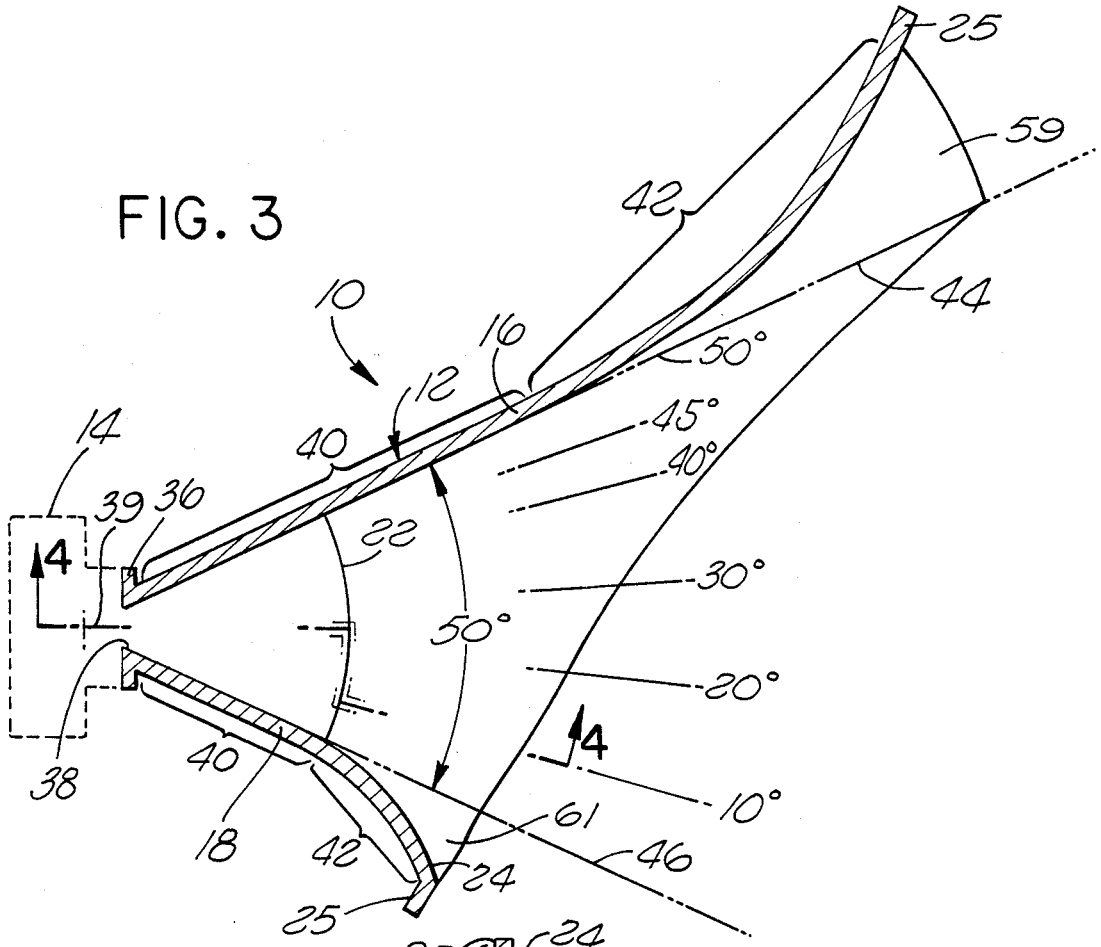
FIG. 3 is a vertical cross-sectional view taken along the line 3—3 of FIG. 1.
Figure 4:
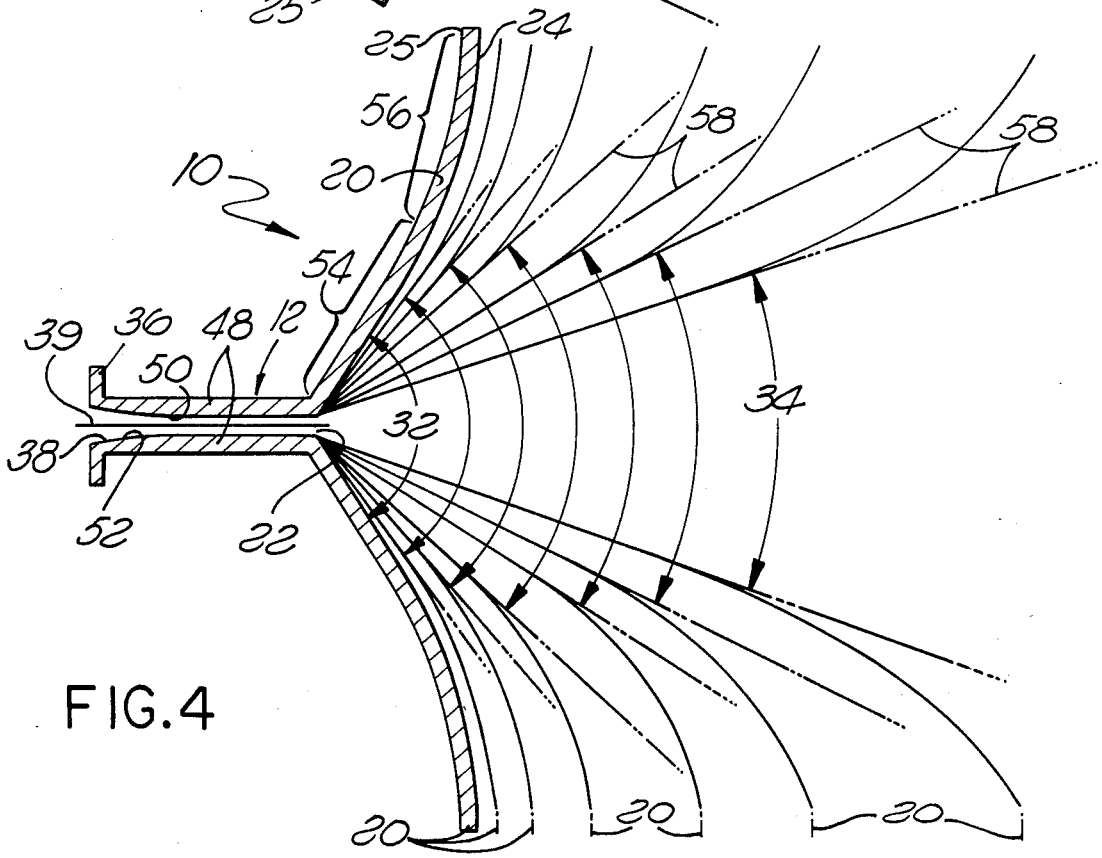
FIG. 4 is a composite sectional view taken along a plurality of lines 4—4 of FIG. 3, the portions at the right hand side of FIG. 3 being displaced angularly relative to each other to illustrate the varying lateral wall angles of the horn as a function of the elevational angle.

The structure of the horn 12 is shown in more detail in FIGS. 3 and 4. The compression driver 14 is suitably affixed to a mounting flange 36 of the horn 12 for application of acoustic signals to a throat 38 of the horn along a principal axis 39. The upper and lower side walls 16 and 18 diverge from the throat 38 at the vertical coverage angle 28 (FIG. 2B) over respective side wall linear regions 40. The coverage angle 28 emanates from an imaginary vertex (not shown) upstream of the gap at a location near the driver. The side walls 16 and 18 then flare out more rapidly over respective outer regions 42. The linear regions 40 may be of different lengths, but are always at least comparable to the longest wavelength for which the horn is to be used. This enables sound to be expanded uniformly over the linear region and directed as a beam substantially conforming to the wall angle 28. Thus, sound exits the horn substantially over the constant angle defined by the broken lines 44 and 46.

FIG. 4 illustrates the configuration of the horn 12 in a direction perpendicular to FIG. 3. Sound from the driver 14 is confined laterally by a pair of substantially parallel walls 48 which define a gap 50 extending from the throat 38 to the outlet 22 of the gap. The width of the gap is comparable to or less than the minimum wavelength with which the horn is to be used, so that sound is radiated in a lateral direction as if the outlet 22 were the sound source. In the embodiment shown, the gap 50 is narrower than the throat 38, requiring a short transition portion 52 between the throat and the gap.

The gap 50 permits expansion in the vertical direction, between the upper and lower walls 16 and 18, while confining the sound in the lateral direction. Lateral expansion commences further downstream, when the sound is effectively radiated in the lateral direction at the gap outlet. At that location, the sound is bounded by the lateral side walls 20 which define different included angles for different elevational directions. The side wall configurations at seven representative elevational angles are shown together in FIG. 4. For clarity, the different lateral cross sections are depicted only for locations downstream of the gap outlet 22, with the gap itself shown as it appears along the axis of the throat 38. In actuality, the lateral side walls 20 vary in angle through a continuum of values between the angles 32 and 34.

As seen clearly in FIG. 4, each cross section of the lateral side walls 20 is composed of a linear region 54 adjacent to the gap outlet 22, and a flared region 56 in the area of the mouth 24. Like the linear regions 40 of the upper and lower side walls, the regions 54 extend downstream a distance at least comparable to the longest wavelength with which the horn is to be used. This assures that sound produced by the driver 14 will be directed from the horn as a beam having included angles similar to the linear regions 54 in the respective elevational directions. Thus, the beam at each cross section is substantially the same as if the linear regions were extended outwardly in the manner of the dashed lines 58. The flared regions 56 of the side walls 20 are similar to the outer regions 42 of the upper and lower side walls.

Referring now to FIGS. 1 and 3, a deviation from the described structure is present at the upper and lower ends of the side walls 20. Because the operative elevational angles are located exclusively between the broken lines 44 and 46, there is no need to vary the angle of the lateral side walls beyond the values at those locations. However, the outward flare of the portions 42 causes the upper and lower side walls to extend away from the directions 44 and 46, leaving a gap between the top wall and the adjacent side walls and between the bottom wall and the adjacent side walls. In the embodiment 10, the gaps are closed by adding surfaces 59 and 61 as defined by swinging the lateral wall profiles at those end locations about a point 57 (FIG. 3) at the apex of the side walls.

Figure 5:
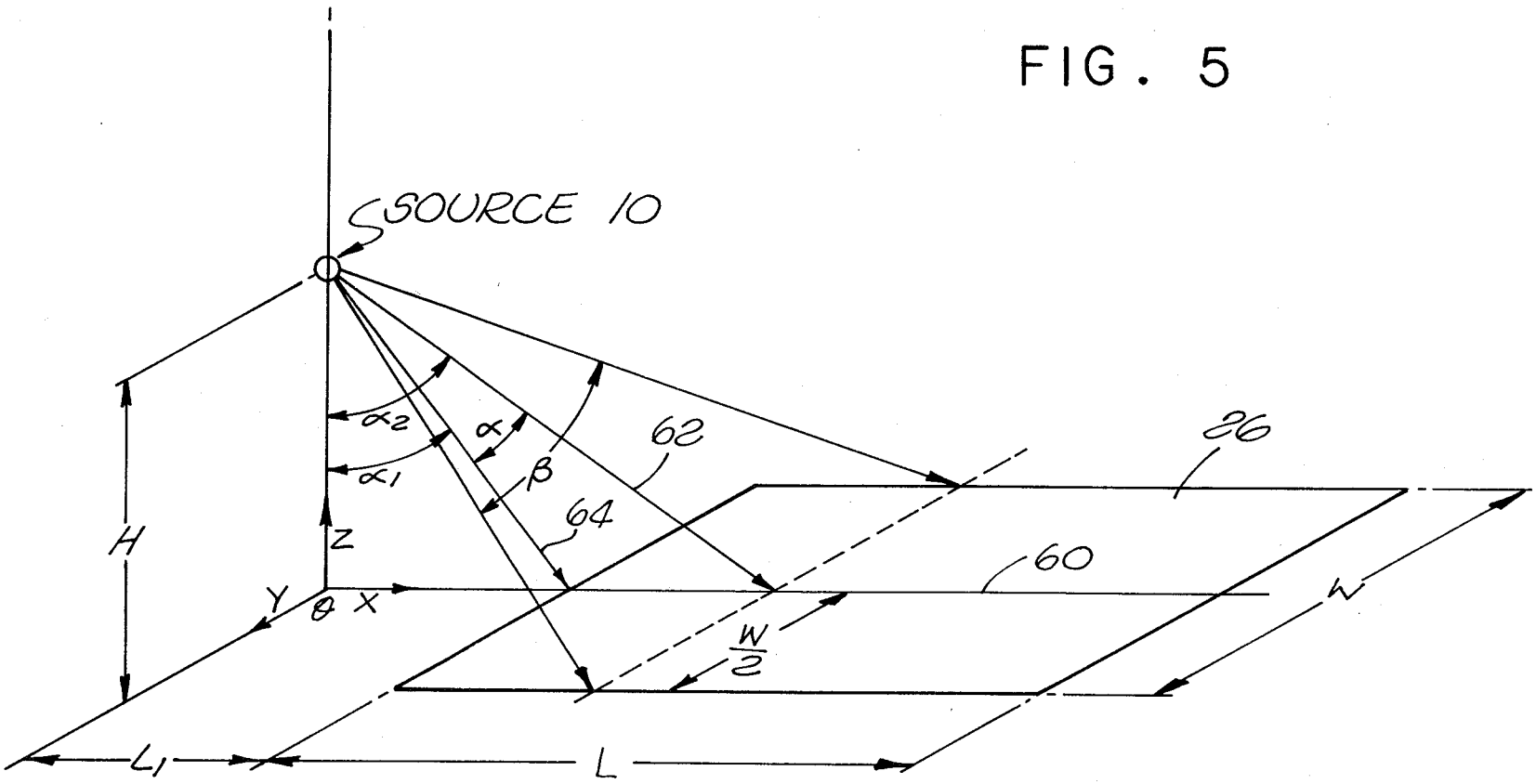
FIG. 5 is a schematic depiction of an acoustic source positioned at a generalized location relative to a rectangular target area.

FIG. 5 is a schematic depiction of the loudspeaker 10 obliquely oriented with respect to the rectangular target area 26. FIG. 5 is included to define the various angular and dimensional relationships of the preferred embodiment. The target area 26 corresponds generally to the ear plane of a group of listeners, such as an audience in a rectangular meeting hall or other room. A source (loudspeaker 10) is located a distance H above the plane of the target area, and directly over a longitudinal axis 60 of the target area. The longitudinal direction of the horn is preferably located within a plane which is perpendicular to and contains the axis of the target. In FIG. 5, the source is H units above the target plane and $L_1$ units behind the target area. The target area is W units wide and L units long. The elevation angle is alpha ($\alpha$), measured from a zero degree (0°) vector 64 directed toward the near end of the target area. The total included lateral coverage angle at each angle of elevation is beta ($\beta$).

Assuming a rectangular coordinate system centered below the source, with the positive "x" axis coinciding with the longitudinal axis 60 of the target, the included coverage angle defined by the walls 20 of the present invention is given as a function of "x", the location along the x axis, by the expression:

$$\beta = 2\tan^{-1}\frac{W}{2\sqrt{x^2+H^2}},$$

where $L_1 \leqq x \leqq [L+L_1]$. $L_1$ can be positive or negative depending upon where the source is placed over the centerline of the target. The expression for the angle $\beta$ is derived from the geometry of FIG. 5, in which $\beta/2$ is the arctangent of one-half the target width divided by the length of a vector 62 from the source to the axis 60. The vector 62 is, of course, equal to $\sqrt{X^2+H^2}$. Thus, $$\beta/2 = \tan^{-1}\frac{W}{2\sqrt{x^2+H^2}} \text{ and } \beta = 2\tan^{-1}\frac{W}{2\sqrt{x^2+H^2}}$$

The total elevation angle of any point on the target axis 60, measured from the vertical direction, is designed $\alpha_2$ (FIG. 5) for purposes of calculation. With the elevation angle of the near end of the target plane defined as $\alpha_1$, the desired elevation angle $\alpha$, measured from the vector 64, is equal to $\alpha_2-\alpha_1$. Since $$\alpha_2=\tan^{-1}(x/H) \text{ and } \alpha_1=\tan^{-1}(L_1/H),$$

$$\alpha=\tan^{-1}(x/H)-\tan^{-1}(L_1/H).$$

It will be understood that, while $\alpha$ and $\beta$ are expressed herein as functions of the running parameter "x", each angle could be expressed in terms of the other by solving one equation for x and substituting the solution into the other equation. However, the formulas have been left in the present form for simplicity.

Although the formulas presented above correspond only to the case of a rectangular target area with the source located directly above the target longitudinal axis, similar expressions can be derived for differently shaped target areas or differently oriented sources. The basic considerations are the same in all cases, i.e., the side walls of the horn must correspond substantially to the line of sight between each point on the source and the corresponding point on the periphery of the target area. The beam produced by the source then coincides generally in breadth with the target area at each location of the target, efficiently distributing sound from the source.

In the specific case of FIGS. 1, 2, 3 and 4, the rectangular target area is 2.645 by 2.0 normalized units in size, and the radiating gap of the loudspeaker 10 is to be located 0.61 units above the target plane and 0.33 units behind the end of the target area. Thus, L=2.645, W=2.0, H=0.61 and $L_1$=0.33. The elevational angle varies from zero to 50 degrees over the length of the target area, and the expressions above can be used to calculate the lateral coverage angle ($\beta$) for each elevational angle ($\alpha$) within the range. Values of the included coverage angles in the illustrated embodiment are given in TABLE I for five degree increments in elevation. The table shows that the included coverage angle varies from a maximum of 110.5 degrees at zero degrees elevation, to a minimum of 36.5 degrees at 50 degrees elevation. The expression for the coverage angle can be used in this way to determine the continuum of angles defined by the side walls 20.

TABLE I

| X (normalized) | Elevational Angle ($\alpha$) (degrees) | Included Coverage Angle ($\beta$) (degrees) |
|---|---|---|
| .330 | 0.0 | 110.5 |
| .402 | 5.0 | 107.7 |
| .484 | 10.0 | 104.2 |
| .577 | 15.0 | 100.0 |
| .687 | 20.0 | 94.8 |
| .822 | 25.0 | 88.7 |
| .992 | 30.0 | 81.3 |
| 1.219 | 35.0 | 72.5 |
| 1.542 | 40.0 | 62.2 |
| 2.048 | 45.0 | 50.2 |
| 2.975 | 50.0 | 36.5 |

A horn having essentially the configurations described above has been fabricated of wood and subjected to preliminary audio testing for sound pressure level (SPL) distribution. Prior to that, a slightly different wooden horn was fabricated. The earlier horn was designed to cover a rectangular target area 2.0 by 2.75 normalized units in size, from a location 1.0 units above the middle of an end line of the area. The total elevational angle in that case was 70 degrees. Audio testing for frequency response was conducted at various angular oreintations relative to the horn, all measurements being taken at equal distances (approximately 3 meters) downstream of the source at a nominal power input of 1 watt per meter. Representative results of such tests are illustrated in FIGS. 6, 7 and 8, wherein sound pressure level (SPL) is expressed in terms of "dB SPL" with respect to a reference point of twenty (20) micro-pascals ($\mu$Pa).

Figure 6:
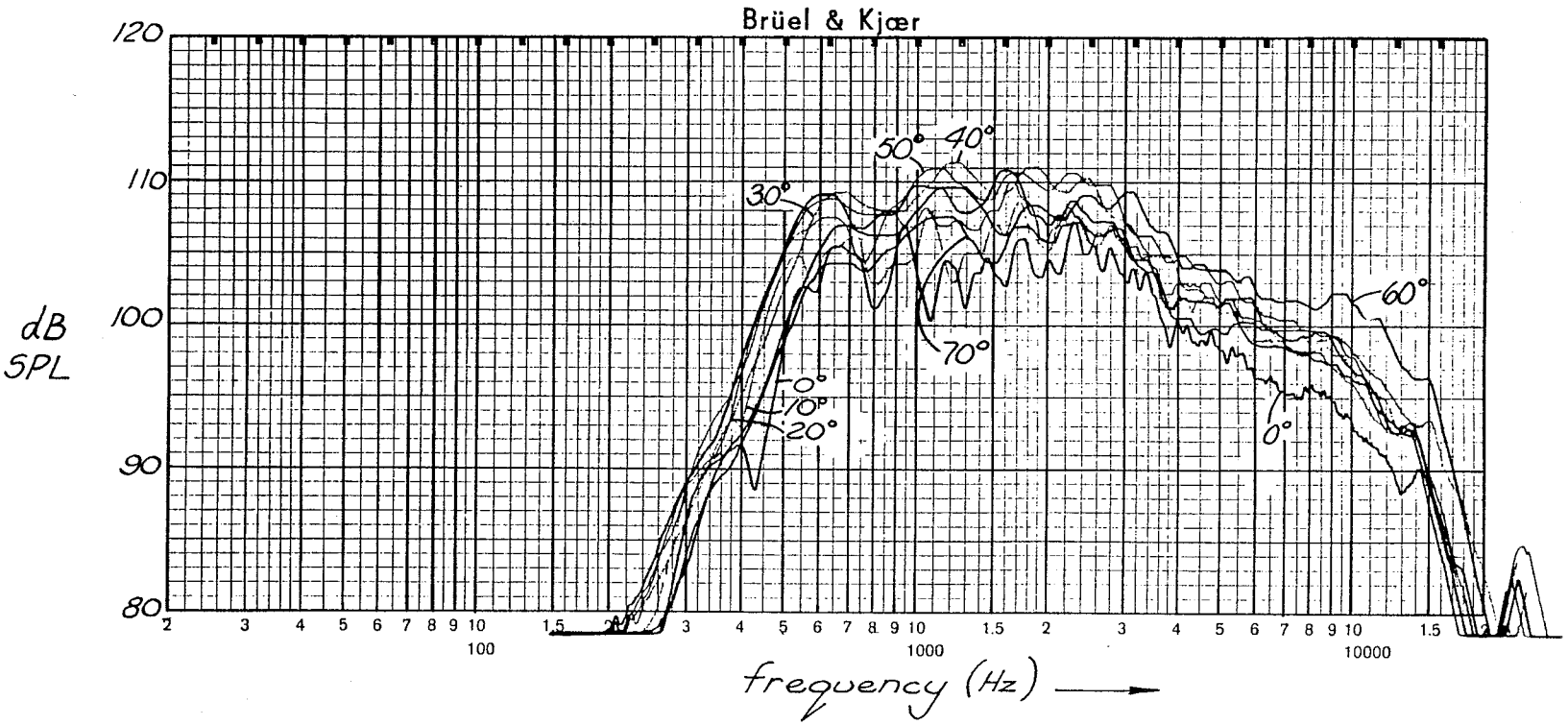
FIG. 6 is a composite set of frequency response curves of a horn constructed according to the present invention, taken at different elevational angles relative to the horn.

FIG. 6 contains a set of frequency response curves taken at different elevational angles relative to the horn, all at zero degrees lateral deflection and at a constant distance from the source. While a conventional radial source would ideally have identical response over its angular range at a uniform downstream distance, the defined coverage horn of the present invention should exhibit a markedly non-uniform response. That is, the greater the elevational angle, the higher the sound pressure level. It can be seen from FIG. 6 that the horn behaved in the expected manner. The 40, 50 and 60 degree curves were the highest in pressure level, with the 70 degree curve slightly lower. The high pressure level in the 40, 50 and 60 degree directions confirms the sound concentrating feature of the invention, while the lower level at 70 degrees shows that the horn was not perfect. If the measurements were taken on the target plane itself, rather than at equal distances downstream of the horn, the result would be a nearly uniform sound pressure level along the axis.

Figure 7:
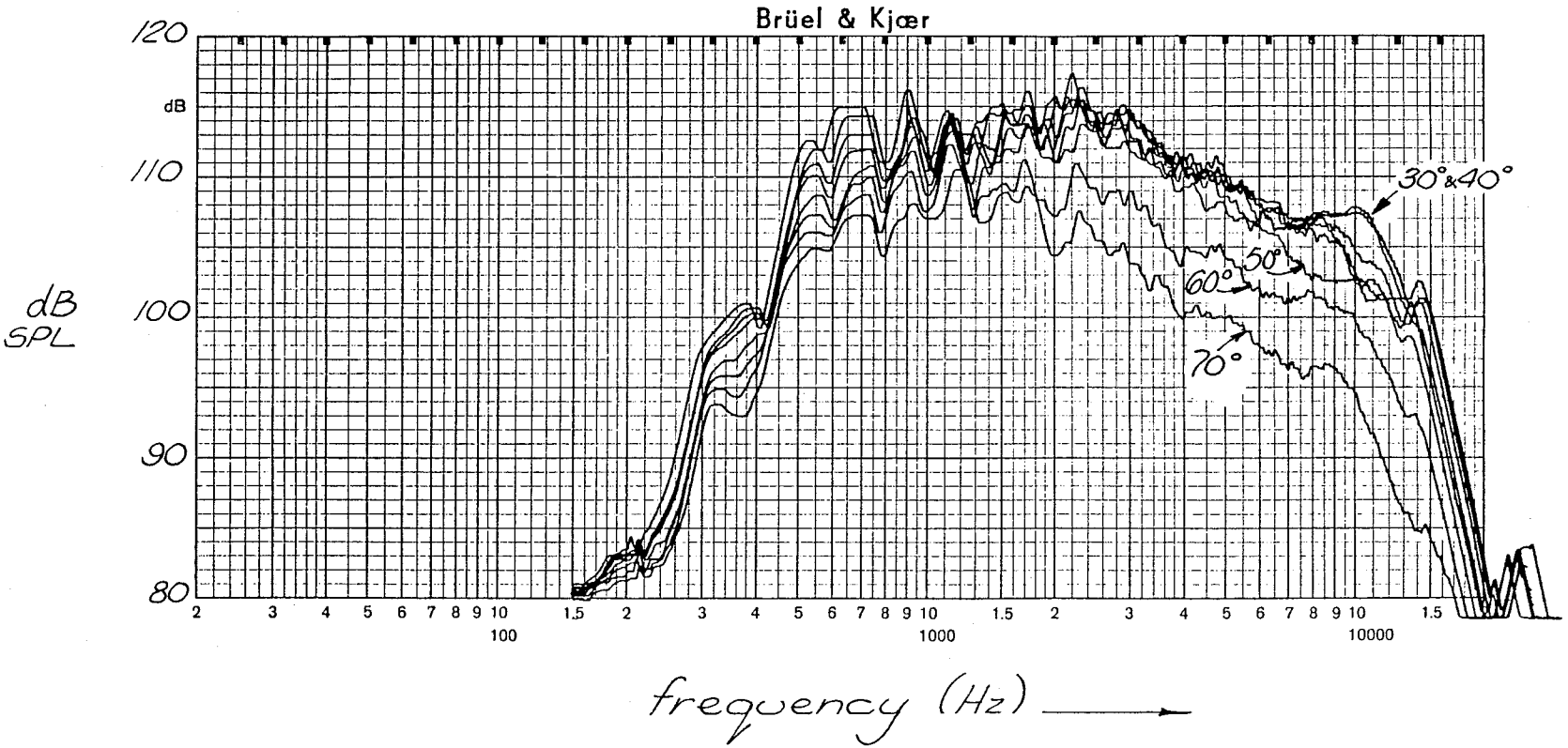
FIGS. 7 and 8 are composite curves showing the lateral off-axis frequency response at elevational angles of zero and 70 degrees, respectively.
Figure 8:
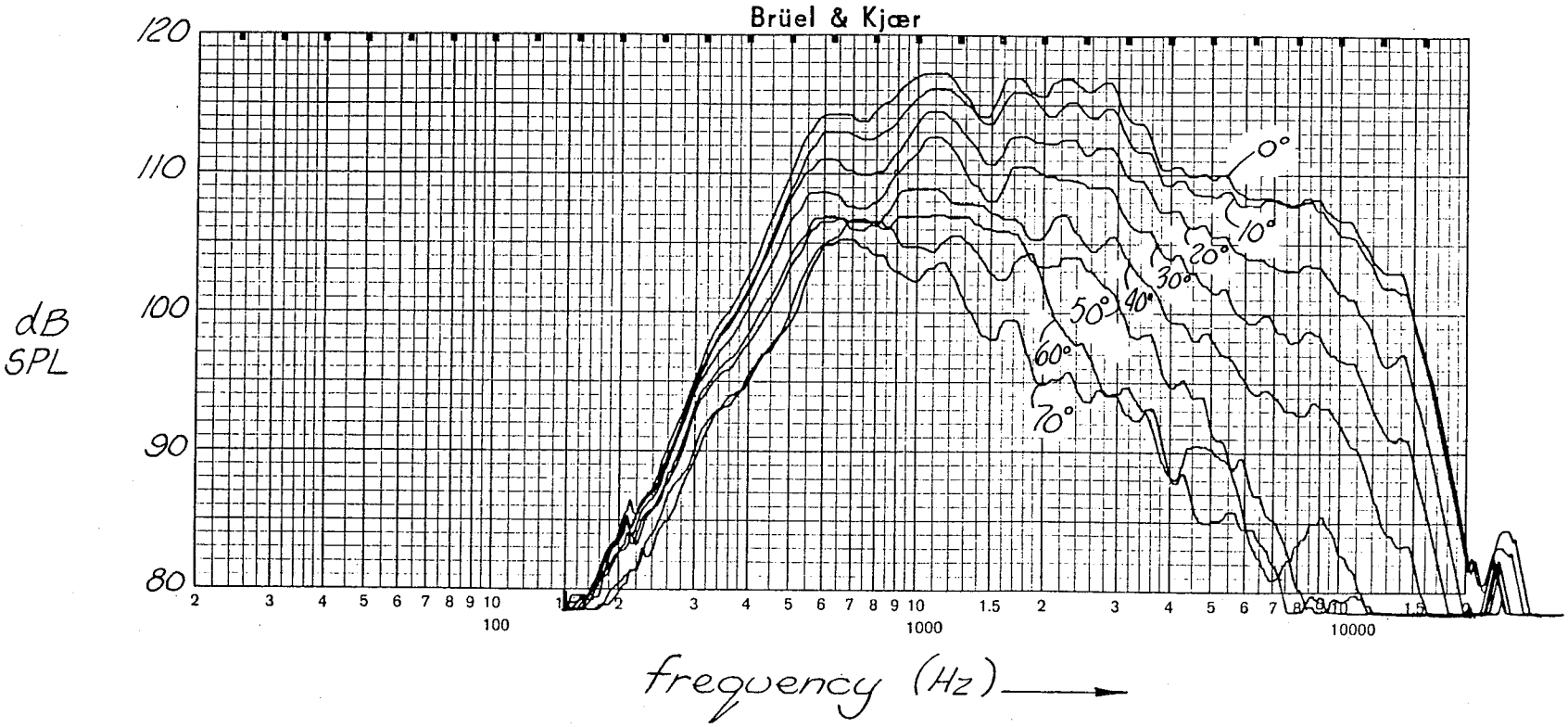

FIGS. 7 and 8 are the lateral off-axis frequency response curves of the early horn, taken at zero and 70 degrees elevation, respectively, at increments of 10 lateral degrees from the axis. A comparison of these curves shows that the horn is much more directive at 70 degrees elevation (FIG. 8) than at zero degrees (FIG. 7). Thus, the high frequency portions of the 70 degree curves in FIG. 8 drop off more rapidly as the probe is moved off the axis. The beamwidths, defined by the 6 dB-down points, are located roughly at the edge of the target at both elevations. Referring specifically to FIG. 8, the 6 dB down points are approximately 20 degrees off-axis. This corresponds to the edge of the target, which is a total of 40 degrees wide at 70 degrees elevation. If extrapolated to the target plane, this beamwidth would nicely cover the width of the target area.

Although the sound distribution of FIGS. 6–8 is not perfect, it is far superior than that obtainable with any other known horn. Similar experimental data has been extracted for locations off the longitudinal axis for representative elevational angles. This data clearly demonstrates the advantages of the invention in distributing sound over a target area in an even and efficient manner. Preliminary testing has also been conducted with the more recent horn constructed using the angular relationships described in TABLE I. Such testing, although not complete, bears out the observations made above.

Although the side walls of the present invention are described herein as being defined substantially by the line of sight between the source and the periphery of the target area, the actual distribution of sound may deviate somewhat from the line of sight case. However, such deviations are relatively minor and, in any event, are readily calculable for correction purposes. For example, the line of sight approximation applies most closely to the case in which the walls of the horn 12 continue outwardly at a constant angle, as shown by the broken lines 44, 46 and 58 of FIGS. 3 and 4. However, it has been found to be advantageous to flare the side walls outwardly at locations adjacent the mouth 24, for purposes of improving coverage and directivity. This phenomenon is described fully in U.S. Pat. No. 4,308,932 to Keele, Jr. which calls for flaring the walls outwardly in accordance with the function:

$$y=a+bx+cx^n,$$

where "x" is the axial distance from the source and "y" is the lateral displacement of the side wall. The constants "a" and "b" are determined by the slope of the linear portion of the horn wall, while the constant "c" and the power "n" determine the extent of curvature desired. Application of this formula to determine the contours of the flared regions 42 and 56 is evident from the '932 patent, which is hereby incorporated by reference. In the case illustrated in the drawings, the power "n" has a value of seven, but in other cases the value can vary between approximately four and eight.

In operation, the horn 12 is coupled with the compression driver 14 and mounted in a desired orientation relative to the target area 26. Because the target area is the listener's ear plane of a room or other structure within which the horn is to be used, the target area remains constant and therefore the horn always occupies the same position. The horn may be attached by suspension or direct mounting, as known in the art. When the horn is directly mounted to the ceiling or other surface of a room, such attachment is made through the peripheral flange 25.

From the above, it can be seen that there has been provided an improved horn arrangement for directing sound produced by an acoustic driver over a suitable defined target area. The frequency response of the horn indicates a very well behaved constant-directivity which in the preferred embodiment gets progressively narrower as the vertical elevation angle is increased. The horn's lateral directional pattern is quite well matched with beamwidth angles to the target area, as seen by the horn at each elevational angle. This defined-coverage horn can be substituted for several conventional horn-driver combinations that would normally be required to adequately cover a rectangular region. However, it can only be used where the acoustical output capabilities of a single driver are adequate. In the case of a rectangular target area, the horn partially compensates for the inverse rolloff of sound pressure with distance in the forward-backward direction.

While certain specific embodiments of the present invention have been disclosed as typical, the invention is of course not limited to these particular forms, but rather is applicable broadly to all such variations as fall within the scope of the appended claims. As an example, the target area need not be rectangular in shape, need not be symmetric about a longitudinal axis, and need not have straight ends. In any case, a desired beam shape can be achieved by configuring opposite side walls of the horn to define appropriate included angles at each cross section. The material of the horn may be any suitable material having sufficient rigidity for use as a loudspeaker horn. Such materials include glass fiber reinforced resin and certain structural foams, including polycarbonate foam.

What is claimed is:

1. A loudspeaker horn for directing sound from a driver to a target area having a plurality of target portions located different distances from the driver, comprising:

an elongated gap means for radiating a sound beam generated by the driver;

a first pair of opposed side walls which extend outwardly from the radiating gap means; and a second pair of opposed side walls which extend outwardly from the radiating gap means and combine with the first-mentioned side walls to define a horn structure;

the first pair of side walls being constructed and arranged to direct a first portion of the beam toward a first portion of the target over a first preselected included angle and to direct at least one other portion of the beam toward another more remote portion of the target over a second different preselected included angle;

said first and second included angles being chosen so that each portion of the beam is substantially coextensive with one of said target portions at a location of incidence thereon.

2. The loudspeaker horn of claim 1 wherein:

the side walls substantially define said included angles over a preselected region adjacent to the radiating gap means and flar outwardly in a nonlinear manner downstream of said region.

3. The loudspeaker horn of claim 2 wherein:

the first-mentioned side walls define a continuum of said included angles.

4. A loudspeaker horn for use with a driver having a principal axis of propagation to direct sound from the driver to a rectangular target area containing a preselected axis, comprising:

means for radiating sound from the driver in first and second orthogonal directions normal to the principal axis of propagation, the radiating means comprising a throat which leads to an elongated gap means to radiate sound primarily in the second direction within the throat and primarily in the first direction upon emission from the gap means, the radiating means being positionable so that the second direction is within a plane which is perpendicular to the target area and contains the axis of the target area; and first and second pairs of opposed side walls extending outwardly from the radiating means to control sound dispersion in the first and second directions, respectively;

the second pair of side walls having portions adjacent to the gap means which define a uniform preselected included angle emanating from an imaginary vertex upstream of the gap means; and the first pair of side walls being symmetrical with each other and having a portion adjacent to the gap means which defines different preselected included angles in different lateral cross sectional planes, each of said planes containing a line which passes through said vertex and is parallel to said first direction.

5. The loudspeaker horn of claim 4 wherein:

the different preselected included angles defined by the first pair of side walls are given by $\beta$ in the expression $$\beta = 2\tan^{-1}\left(\frac{W}{2\sqrt{x^2 + H^2}}\right),$$

where W is the lateral dimension of the target, H is the height of the radiating means above the plane of the target, and X is the distance in the plane of the target between a point directly below the radiating means and a point of interest along the axis of the target area.

6. In a loudspeaker horn for directing sound from a source having a principal axis of propagation to a target area, which horn includes means for defining an elongated radiating gap having major and minor dimensions normal to the axis of propagation and side wall means having first and second pairs of opposed side walls extending downstream from the radiating gap for controlling sound dispersion in the directions of the minor and major dimensions of the radiating gap, respectively, the second pair of side walls having regions adjacent to the gap which define a uniform preselected included angle emanating from an imaginary vertex upstream of the gap, the improvement comprising:

the first pair of side walls having a portion adjacent to the radiating gap which defines different preselected included angles in different lateral cross sectional planes, each of said planes containing a line which passes through the vertex of the second pair of side walls and is parallel to the minor dimension of the radiating gap.

7. The loudspeaker horn of claim 6 wherein:

the side walls of the first pair are substantially symmetrical with each other.

8. The loudspeaker horn of claim 7 wherein:

the side walls flare outwardly in a nonlinear manner at locations further downstream of the radiating gap than the portion which defines said angles.

9. The loudspeaker horn of claim 6 in which:

the second pair of side walls extend a preselected distance upstream of the radiating gap to define said uniform preselected included angle.

* * * * *